US007694464B2

(12) United States Patent
Garcia et al.

(10) Patent No.: US 7,694,464 B2
(45) Date of Patent: Apr. 13, 2010

(54) CEILING ROCKER

(76) Inventors: Rodolfo Garcia, 5 Alber tAnna Ct., Hopewell Junction, NY (US) 12533; Angela Garcia, 5 AlbertAnna Ct., Hopwell Junction, NY (US) 12533; Reinaldo Garcia, 6 Glenbrook Ct., Wappingers Falls, NY (US) 12590; Marcella Garcia, 6 Glenbrook Ct., Wappingers Falls, NY (US) 12590; Clara Shults Toulan, 49 Lane Gate Rd., Wappingers Falls, NY (US) 12590; Daniel Toulan, 49 Lane Gate Rd., Wappingers Falls, NY (US) 12590

( * ) Notice: Subject to any disclaimer, the term of this patent is extended or adjusted under 35 U.S.C. 154(b) by 0 days.

(21) Appl. No.: 12/106,156

(22) Filed: Apr. 18, 2008
(Under 37 CFR 1.47)

(65) Prior Publication Data

US 2008/0258028 A1 Oct. 23, 2008

Related U.S. Application Data

(60) Provisional application No. 60/925,550, filed on Apr. 21, 2007.

(51) Int. Cl.
*E04B 7/00* (2006.01)

(52) U.S. Cl. ..... 52/94; 52/518; 52/483.1; 52/746.1; 52/747.1

(58) Field of Classification Search ..... 52/483.1, 52/489.1, 506.06, 506.07, 506.09, 664, 669, 52/94

See application file for complete search history.

(56) References Cited

U.S. PATENT DOCUMENTS

| | | | | |
|---|---|---|---|---|
| 3,667,177 | A * | 6/1972 | Biela | 52/278 |
| 4,449,338 | A | 5/1984 | Reicherts | |
| 4,709,460 | A | 12/1987 | Luhowyj | |
| 4,733,509 | A * | 3/1988 | Takahashi | 52/126.5 |
| 5,224,309 | A | 7/1993 | Bodell | |
| 5,366,329 | A | 11/1994 | Burgess | |
| 5,371,994 | A | 12/1994 | Waters | |
| 5,377,463 | A * | 1/1995 | Howe | 52/200 |
| 5,657,585 | A * | 8/1997 | Zaccagni | 52/94 |
| 5,836,113 | A * | 11/1998 | Bachman | 52/94 |
| 6,131,361 | A | 10/2000 | Murphy | |
| 6,170,214 | B1 * | 1/2001 | Treister et al. | 52/511 |
| 6,286,285 | B1 | 9/2001 | Martell | |
| 6,904,732 | B1 | 6/2005 | Richmond | |
| 7,299,595 | B1 * | 11/2007 | Anderson, Sr. | 52/506.05 |
| 7,472,521 | B2 * | 1/2009 | Bilge | 52/235 |
| 2002/0152704 | A1 * | 10/2002 | Thompson et al. | 52/506.06 |
| 2006/0010812 | A1 * | 1/2006 | Jones et al. | 52/506.07 |
| 2007/0175157 | A1 * | 8/2007 | Zahner | 52/582.2 |

FOREIGN PATENT DOCUMENTS

| | | | |
|---|---|---|---|
| GB | 2371829 | A | 7/2002 |

* cited by examiner

*Primary Examiner*—Richard E Chilcot, Jr.
*Assistant Examiner*—Alp Akbasli
(74) *Attorney, Agent, or Firm*—Kenneth Bower

(57) ABSTRACT

The present invention is an apparatus and method that enables a single installer to attach panels, such as drywall sheets, to overhead surfaces without the help of a second person to support the sheet against a ceiling while the installer performs the fastening. Two components are included, a fixed shelf and a movable shelf. Each component is elongated to support approximately half of the edge of the panels, so that the installer need not manipulate multiple brackets before securing the panels to the ceiling.

6 Claims, 4 Drawing Sheets

Figure 4A:
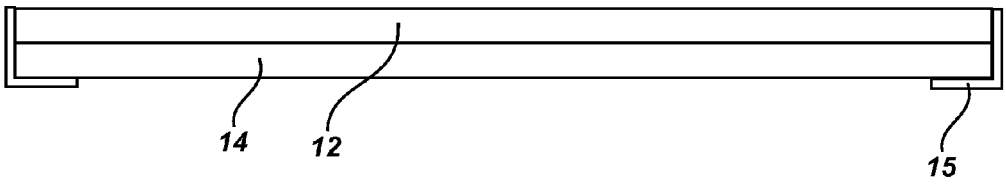

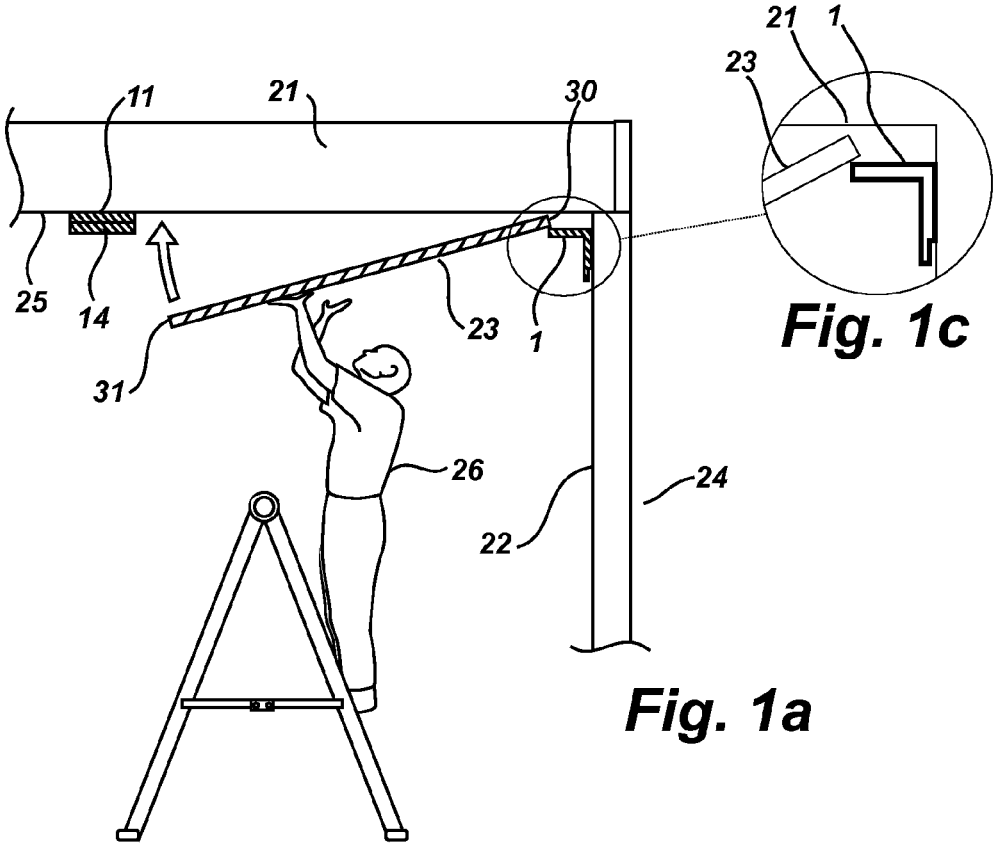
Fig. 1c
Fig. 1a
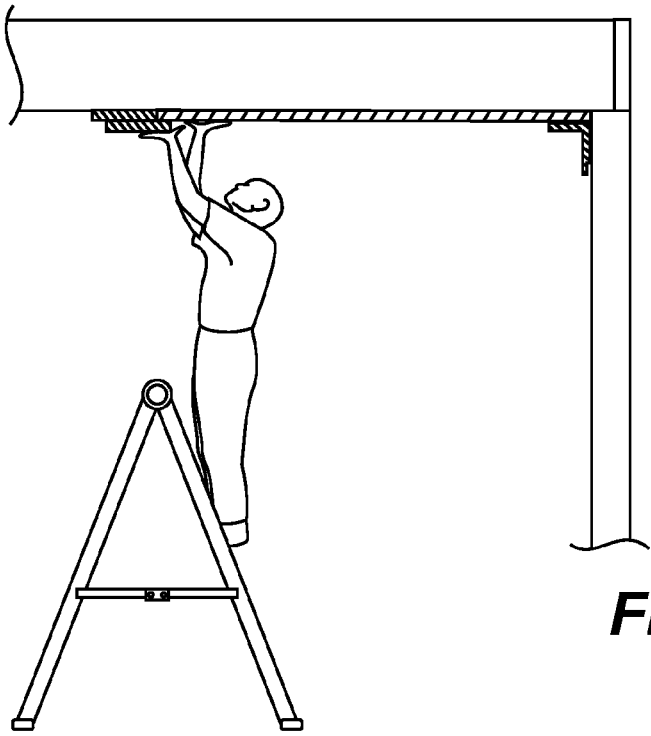
Fig. 1b

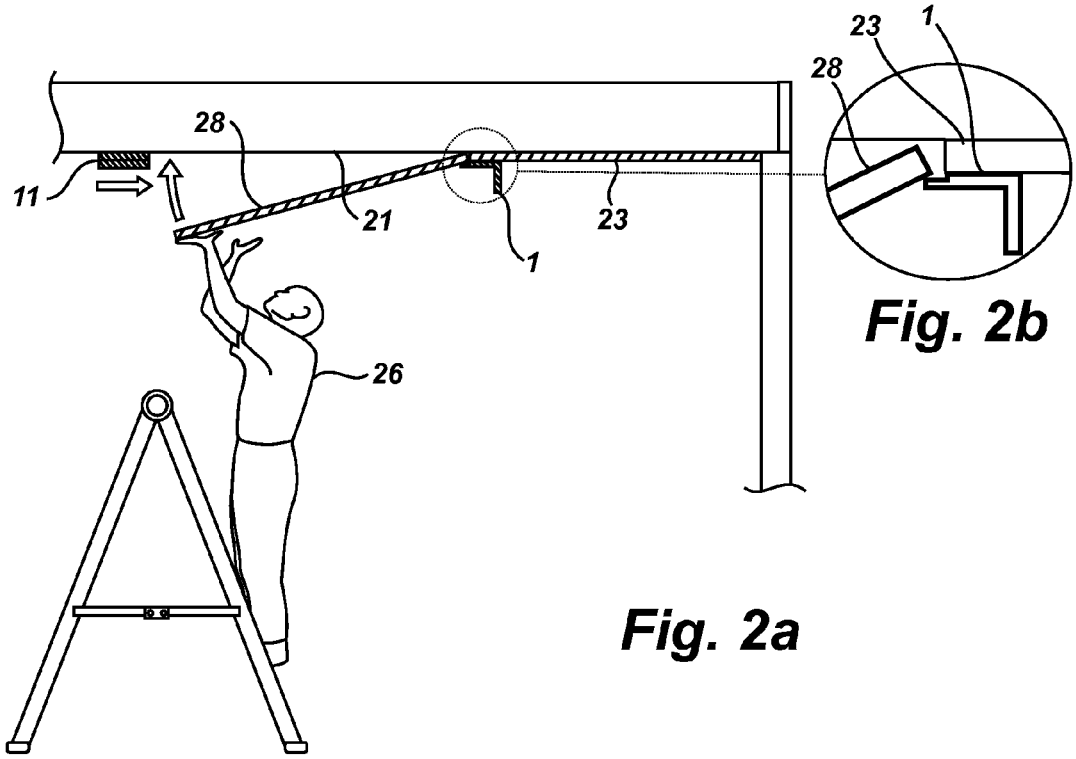
Fig. 2b
Fig. 2a
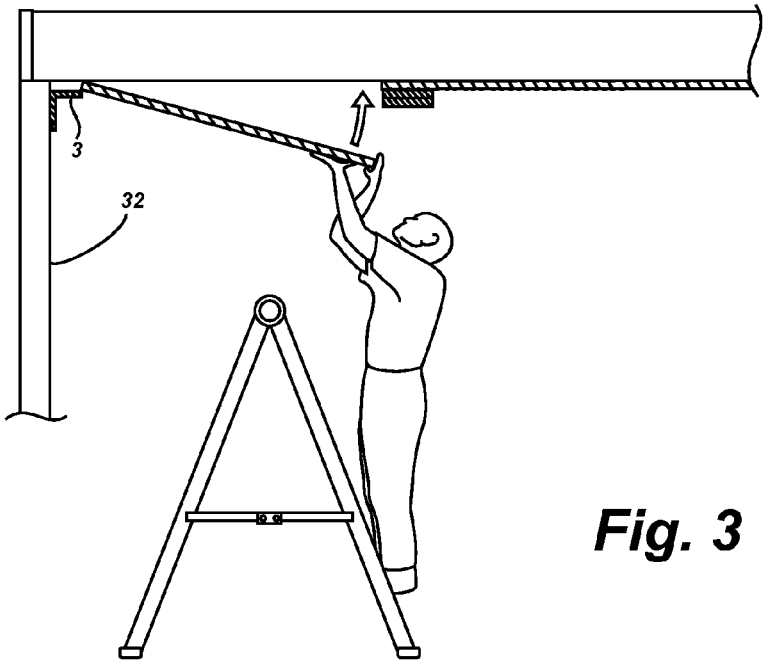
Fig. 3

CEILING ROCKER

CROSS-REFERENCE TO RELATED APPLICATIONS

The present application claims the benefit of U.S. Provisional Application No. 60/925,550 filed on Apr. 21, 2007.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to installation of panels in new or existing construction. The preferred embodiment of the present invention relates to methods and devices for temporarily supporting panels against ceilings while the installer permanently secures the panels in place.

2. Description of Related Art

Since being introduced into home construction, mass produced drywall paneling, or sheet rock, has greatly increased efficiency in the area of wall and ceiling covering. Drywalling has largely replaced the labor-intensive, time-consuming process of plastering.

The standard size of a drywall panel is four by eight feet. The placement and securing of drywall on a vertical surface, such as a wall, has a simple process. The installer needs only start at the floor level and hold the drywall against the wall studs while securing it. The next panel up is supported by the panel below it. What used to take several days and require workers skilled in the art of mixing and placing plaster could now be done in a matter of hours.

Unfortunately, the same attributes that make drywall panels so much easier to install on walls are disadvantages when installing the panels on ceilings. Namely, the large size and composition of the panels makes them unwieldy for one person to install on a ceiling. In most cases, at least two people are required, one to hold the sheet rock in place against the ceiling joists and one to secure it with nails or screws. This means that ceiling installation usually requires a second person, which adds to the cost of home construction.

A number of devices and methods have been proposed to aid sheet rock installers with the handling of the awkward, large, heavy and easily damaged panels while wielding a hammer or screw driver to secure the panels in place. This is a particularly difficult task when the installer is working alone. Various floor mounted jacks and complicated wall or ceiling mounted work holders have been devised. In addition various temporarily mounted brackets have also been proposed.

By way of example, U.S. Pat. No. 4,449,338 to Reicherts provides a fixed shelf with an upper plate for supporting one panel edge. However, it does not provide a surface that supports the complete length of the panel. Therefore, Reicherts requires multiple devices to be mounted on the ceiling and positioned separately along the same line to support a single panel in place during installation.

U.S. Pat. No. 5,224,309 to Bodell provides a sliding shelf with a slidable plate for supporting the opposing panel edge. However, it does not provide a surface for supporting the complete length of the panel. Therefore, an installer must mount multiple devices on the ceiling at separate positions to support one panel in place during installation.

U.S. Pat. No. 5,371,994 to Waters provides a fixed support surface for supporting the panel in place while being secured. However, it does not provide a slidable shelf for support of a full side of the panel. Therefore, to install a single panel the installer must mount multiple devices on the ceiling along a single line support the panel.

U.S. Pat. No. 6,131,361 to Murphy provides a fixed shelf with slotted attachment holes for mounting below a ceiling joist and has an upper plate for supporting one edge of the panel. However, it does not provide a slidable shelf that supports a full edge of the panel. Therefore, multiple devices mounted on the ceiling and separate positioning of the multiple devices are necessary to support one panel in place during installation.

U.S. Pat. No. 6,904,732 to Richmond provides an upper plate for supporting one edge of a panel. However, Richmond does not provide a slidable shelf or positioning in a single motion for holding a panel in place during installation.

U.S. Published Application Number 2008/0040988 by Holt provides a fixed shelf with slotted attachment holes for mounting below the ceiling joists and has an upper plate for supporting one panel edge. However, Holt does not provide a slidable shelf for holding a panel in place while being secured. Therefore, multiple devices mounted on the ceiling and separate positioning of the multiple devices are necessary to support one panel in place during installation. Also, the clamping mechanism of Holt does not allow the device to be temporarily mounted on a finished wall, which will often be the case in situations where only the ceiling is being covered.

U.S. Pat. No. 4,709,460 to Luhowyj provides an upper plate for supporting one ceiling covering panel edge. It provides support along a complete edge. However, it does not provide a slidable shelf for holding a piece of ceiling covering while being secured. Therefore, it is necessary to mount multiple devices on the ceiling at separate positions to support one panel in place during installation.

U.S. Pat. No. 5,366,329 to Burgess provides an upper plate for supporting one panel edge. However, Burdgess does not provide a slidable shelf for holding a panel in place while being secured. Also, Burgess requires multiple devices to be temporarily mounted to the ceiling along the same line to hold a panel in place. Therefore, multiple devices mounted on the ceiling and separate positioning of the multiple devices are necessary to support one panel in place during installation.

U.K. Patent Application GB2371829A by Johnston provides a fixed plate for holding one edge of a piece of drywall in place. However Johnston does not provide a slidable shelf for holding a panel in place while being secured. Also, Johnston requires multiple devices to be temporarily mounted to the ceiling along the same line to hold a panel in place.

What is needed is an installation device that includes a fixed shelf with slotted attachment holes for mounting below ceiling joists, with an upper plate for supporting one drywall panel edge, while providing a sliding shelf with slotted attachment holes for mounting to the ceiling joist and a slidable plate for supporting the opposing drywall panel edge.

BRIEF SUMMARY OF THE INVENTION

The preferred embodiment of the present invention is a system comprised of two components that enable a single person or an installer to easily attach a panel, such as sheet rock or drywall, to a structural members, such as a ceiling. The two components are a first support apparatus and a second support apparatus. The first support apparatus is a fixed shelf and the second support apparatus is a movable shelf. The fixed shelf can be mounted on a vertical wall when the panel is located at the edge of the ceiling. Or the fixed shelf can be mounted to the ceiling when the panel is located in an interior portion of the ceiling (i.e. when the panel is spaced away from all vertical walls). The movable shelf can be mounted approximately four feet away from the fixed shelf, such that the movable shelf can support the opposing edge of a four foot wide panel.

In operation, the fixed shelf is first mounted on one or more wall studs approximately 1 inch below the ceiling joists. Next, the movable shelf is mounted to the ceiling joists approximately 4 feet away from the fixed shelf. Now an installer can place a panel between the fixed shelf and the ceiling joists. The panel is now supported along approximately half of one edge. Next, the installer rotates the panel toward the ceiling joist. Once the panel is in position against the ceiling joist, the installer can manually move a sliding plate of the movable shelf with a single motion to a position where the sliding plate will support the panel. And since the sliding plate supports the panel along the entire edge of the panel, the installer does not need to move a ladder nor does the installer need to make a dangerous reach to adjust additional installation brackets.

Once the first panel has been permanently fastened to the ceiling joists, the installer can then remove both the fixed shelf and the movable shelf. Next, the installer can use the fixed shelf and the movable shelf in a slightly different manner to mount an intermediate panel. The installer can mount the fixed shelf on top of the first panel that was attached. The fixed shelf has one stepped leg which provides a support surface slightly lower than the first panel. Next, the installer can mount the movable shelf approximately four feet away from the fixed shelf. The intermediate panel is then installed in the same manner in which the first panel was installed. Finally, the installer can remove and re-attach the fixed shelf and the movable shelf for installation of an end panel.

There has thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention is to provide a panel installation apparatus that enables a single installer to attach panels to an overhead structure.

Yet another object of the present invention to provide a panel installation apparatus that is lightweight, durable and inexpensive to manufacture.

It is a further object of the present invention to provide panel installation apparatus that can be used for attaching first, intermediate and end panels to a ceiling.

It is a further object of the present invention to provide a panel installation apparatus that can be easily transported from site to site while occupying minimal space.

It is yet a further object of the present invention to provide a panel installation apparatus that will avoid damaging panels during the installation process.

BRIEF DESCRIPTION OF THE SEVERAL VIEWS OF THE DRAWING(S)

FIG. 1*a* shows an end view of an installer placing a first panel on a fixed shelf.

FIG. 1*b* shows an end view of the installer rotating the first panel toward a ceiling, and subsequently locking the first panel in position with a movable shelf.

FIG. 1*c* shows an enlarged view of the fixed shelf as seen in FIG. 1*a*.

FIG. 2*a* shows an end view of the installation of an intermediate wall panel.

FIG. 2*b*. shows an enlarged view of the fixed shelf as seen in FIG. 2*a*.

FIG. 3 shows an end view of the installation of an end panel.

FIG. 4*a* shows a side view of the movable shelf.

Figure 4B:
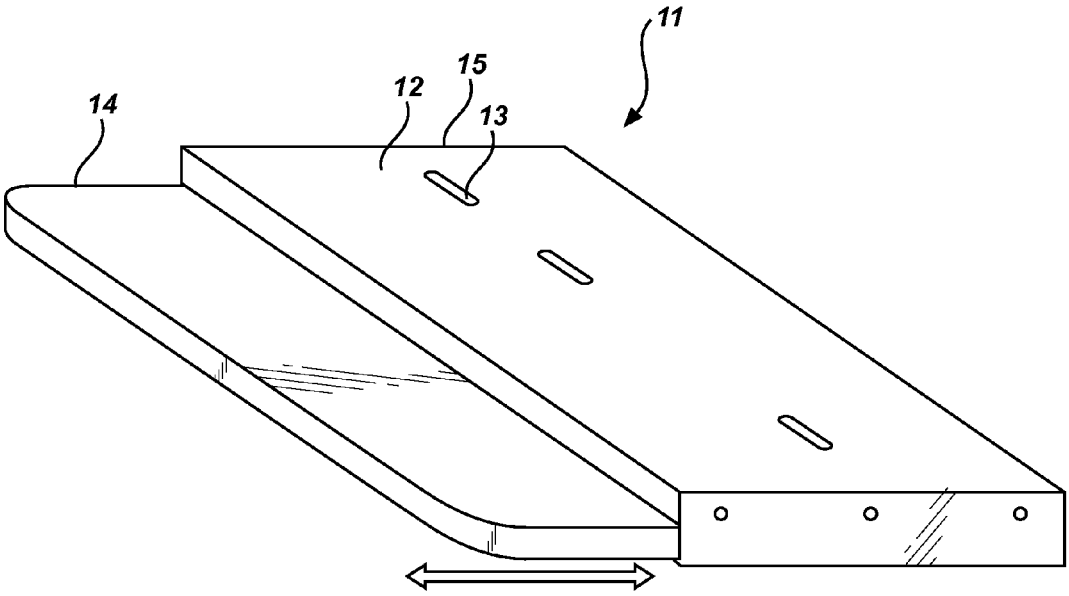

FIG. 4*b* shows a perspective view of the movable shelf.

Figure 5A:
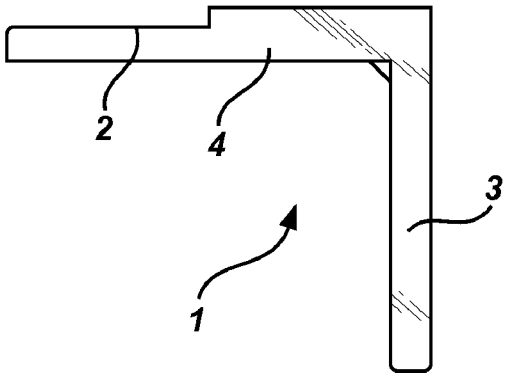

FIG. 5*a* shows a side view of the fixed shelf.

Figure 5B:
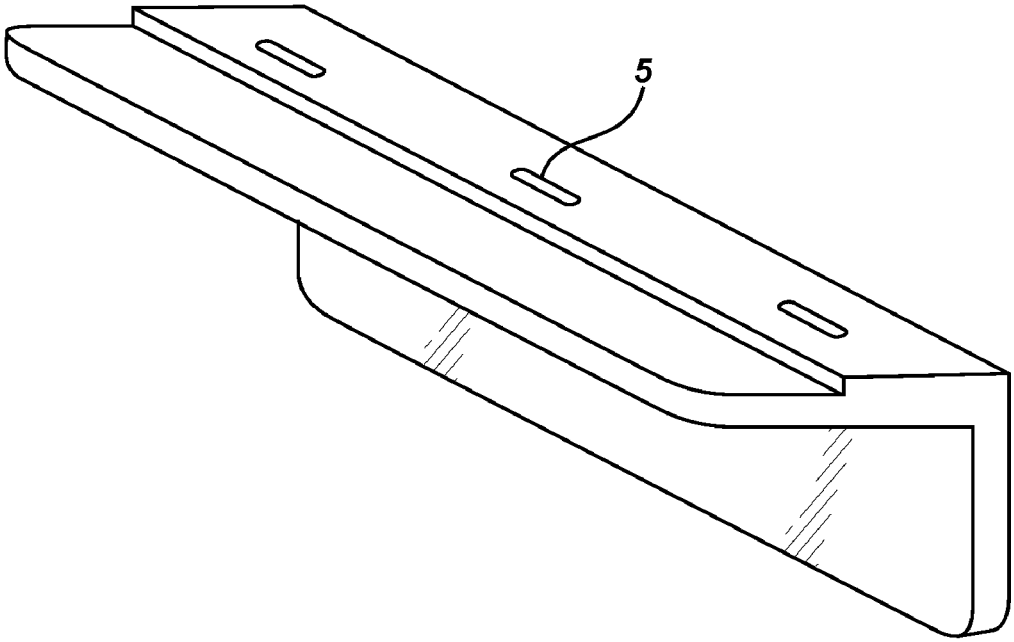

FIG. 5*b* shows a perspective view of the fixed shelf.

DETAILED DESCRIPTION OF THE INVENTION

Referring now to FIG. 1*a-b*, the present invention is shown for installing a first panel 23 to a ceiling 25. A fixed shelf 1, or a first support apparatus, is temporarily mounted to a first vertical wall 24. Next, a movable shelf 11, or a second support apparatus, is temporarily mounted to one or more ceiling joist 21. An installer 26, which is a single person, carries the first panel 23 up a ladder 27, and places a first edge 30 of the first panel 23 between the ceiling joist 21 and the fixed shelf 1. As seen in FIG. 1*b*, the installer 26 then rotates the first panel 23 such that a second edge 31 moves toward the ceiling joist 21. Once the first panel 23 is horizontal, a sliding plate 14, or a movable member, is manually moved in a single motion from the position shown in FIG. 1*a* to the position shown in FIG. 1*b*. Two full edges of the first panel 23 are now supported, and the installer 26 can use screws or nails to permanently attach the first panel 23 to the ceiling joist 21. Referring now FIG. 1*c*, an enlarged view of the fixed shelf 1 from FIG. 1*a* is shown. As seen, the fixed shelf 1 is installed with the stepped leg 4 on the first vertical wall 24.

Referring now to FIG. 2-3, the present invention is shown for installing an intermediate panel 28 and an end panel 29. The fixed shelf 1 is mounted on top of the first panel 23 such that a stepped leg 4 of the fixed shelf 1 extends away from the first panel 23. Next, the movable shelf 11 is mounted to the ceiling joist 21 approximately four feet away from the fixed shelf 1. The intermediate panel 28 is then inserted between the ceiling joist 21 and the stepped leg 4. Next, the intermediate panel 28 is rotated up to the ceiling joist 21. The installer then manually slides the sliding plate 12 toward the fixed shelf 1. Finally, the installer 26 permanently attaches the intermediate panel 28 to the ceiling joist 21. The installer 26 then removes both the fixed shelf 1 and the movable shelf 11. Referring now FIG. 2*b*, an enlarged view of the fixed shelf 1 from FIG. 2*a* is shown. As seen, the fixed shelf 1 is installed with the stepped leg 4 on the first panel 23. Referring now to FIG. 3, the present invention is shown for mounting an end panel 29. The fixed shelf 1 is mounted to a second vertical wall 32 with the straight leg 3 of the fixed shelf 1 oriented horizontally. The movable shelf 11 is mounted on top of the intermediate panel 28. The end panel 29 is then inserted between the straight leg 3 and the ceiling joist 21. The end panel 29 is then rotated toward the ceiling joist 21. The installer 26 then slides the sliding plate 14 to support the end panel 29. Next, the installer 26 permanently attaches the end panel 29 to the ceiling joist 21. The installer 26 then removes both the fixed shelf 1 and the movable shelf 11.

Referring now to FIG. 4*a-b*, the movable shelf 11 is shown in detail. The movable shelf 11 has a sliding shelf mount plate 12 which is an elongated board of roughly 24 inches in length. The sliding shelf mount plate 12 has one or more slotted thru hole 13 which enable removable mounting to the ceiling joist 21. In addition, sliding shelf mount plate 12 has two guide angle plate 15 affixed to opposing edges of the sliding shelf mount plate 12. The guide angle plate 15 supports the sliding plate 14 along multiple positions between contracted inside the movable shelf 11 to the extended position shown in FIG. 4*b*. The sliding plate 14 slides freely in and out of the sliding shelf mount plate 12.

Referring now to FIG. 5*a-b*, the fixed shelf 1 is shown in detail. The fixed shelf 1 has straight leg 3 and a stepped leg 4. The stepped leg 3 has one or more slotted thru hole 5 for mounting to the first vertical wall 24 or the second vertical wall 32. The stepped leg 4 has a step 2 for panel support when the fixed shelf 1 is used to mount the intermediate panel 28. The slotted thru hole 5 on the stepped leg 4 is also used when mounting the fixed shelf 1 to the ceiling joist 21. As with the movable shelf, the overall length is approximately 24".

It should be understood that the preceding descriptions are meant to show the preferred embodiment of the present invention and the preferred method of using the invention. Changes could be made without deviating from the spirit of the present invention. For instance, in another embodiment the inventor also envisions that the sliding plate could be provided with an end of travel stop, such that the sliding plate cannot slide out of contact with the sliding shelf mount plate. In addition, in another embodiment, the fixed shelf could be provided with a screw actuated movable plate such that the fixed shelf could be used to lift panels upward on the vertical wall.

The invention claimed is:

1. A support system adapted for a single person to lift and support a panel of drywall into a temporary position for subsequent fastening of the panel to a ceiling joist comprising:

a wall having a top at a height of a ceiling joist and a front surface;

said ceiling joist extending outward from the wall and having a lower surface;

the panel having a thickness;

a first elongated support apparatus having a first surface that is continuous and planar and a second surface in orthogonal orientation to the first surface that is planar in part and has at least one opening for mounting directly against the front surface of the wall or to at least one ceiling joist and a step at a distal edge furthest from the first surface;

an elongated sliding component of essentially rectangular cross section;

a second elongated support member having an upper surface and a lower surface in parallel relation; and a guide member coupled to said second elongated support member for slidably holding the elongated sliding component below said lower surface of said second elongated support member.

2. The system of claim 1 wherein the thickness of the second elongated support member is essentially the thickness of the drywall panel.

3. The system of claim 2 wherein said second elongated support member has at least one opening for removably mounting said second elongated support member to a ceiling joist.

4. The system of claim 3 wherein said at least one opening is slotted.

5. The system of claim 3 wherein said guide member for slidably holding the elongated sliding component comprises angle plates affixed to opposing edges of the second elongated support member.

6. A method for supporting a panel of drywall in a temporary position while fastening the panel of drywall to at least one ceiling joist comprising:

providing a first elongated support member;

providing a second elongated support member;

providing an elongated sliding member that is slidably attached to the second elongated support member;

fastening the first elongated support member to a front surface of a wall structure leaving a gap of at least the thickness of a panel of drywall between the first surface and at least one joist of a ceiling structure;

fastening the second guide member to at least one joist of the ceiling structure and at least the width of the panel of dry wall from the front surface of the wall structure;

sliding a first edge of the panel of drywall between the first elongated member and the at least one joist of the ceiling structure;

rotating the panel of drywall to a position against the at least one joist of the ceiling structure and between the first elongated support member and the second elongated support member;

sliding the slide member over a second edge of the panel of drywall;

allowing the panel of drywall to rest on the first elongated support member and the sliding member;

fastening the panel of drywall to the one or more joists of the ceiling structure;

removing the first elongated member from the surface of the wall structure;

removing the second elongated member and sliding member from the one or more joists of the ceiling structure.

* * * * *